United States Patent [19]

Pollich

[11] Patent Number: 5,029,844

[45] Date of Patent: Jul. 9, 1991

[54] DEVICE FOR ADJUSTING FRONT LAYS

[75] Inventor: Gerhard Pollich, Heidelberg, Fed. Rep. of Germany

[73] Assignee: Heidelberger Druckmaschinen AG, Heidelberg, Fed. Rep. of Germany

[21] Appl. No.: 402,868

[22] Filed: Sep. 5, 1989

[30] Foreign Application Priority Data

Sep. 3, 1988 [DE] Fed. Rep. of Germany ..... 3830081

[51] Int. Cl.[5] ..... B65H 9/04

[52] U.S. Cl. ..... 271/245

[58] Field of Search ..... 271/245, 246

[56] References Cited

U.S. PATENT DOCUMENTS

| | | | |
|---|---|---|---|
| 2,950,916 | 8/1960 | Backhouse | 271/245 X |
| 3,081,080 | 3/1963 | Weber | 271/245 X |
| 3,173,685 | 3/1965 | Backhouse | 271/245 |

FOREIGN PATENT DOCUMENTS 2451461 5/1976 Fed. Rep. of Germany .

*Primary Examiner*—Richard A. Schacher

*Attorney, Agent, or Firm*—Herbert L. Lerner; Laurence A. Greenberg

[57] ABSTRACT

A device for adjusting front lays of a printing machine to which sheets are individually fed by a sheet feeder includes a front lay shaft to which the front lays are connected so as to be fixed against rotation relative thereto, a first and a second swivel part respectively swivellable about a stationary geometric swivel axis common to the swivel parts, the front lay shaft being mounted in the first and the second swivel parts so as to be freely rotatable relative thereto, an adjusting device engaging the first and the second swivel parts for changing the position of the front lay shaft, a swivel device for swivelling the front lay shaft reciprocatingly about a longitudinal axis thereof, and at least one supporting bearing for the front lay shaft for following changes in the position thereof, the adjusting device being in engagement with the front lay shaft in close proximity with the supporting bearing.

7 Claims, 2 Drawing Sheets

DEVICE FOR ADJUSTING FRONT LAYS

Device for adjusting front lays for sheets which are fed individually to a printing machine by a sheet feeder, and, more particularly, to such a device wherein the front lays are connected to a front lay shaft so as to be fixed against rotation, and including a first and a second swivel part respectively swivellable about a stationary geometric swivel axis common to both swivel parts, the front lay shaft being mounted in each of the swivel parts so as to be freely rotatable relative thereto, adjusting means engaging the two swivel parts for changing the position of the front lay shaft, and a swivel device for swivelling the front lay shaft reciprocatingly about its longitudinal axis.

Such a device has become known heretofore from German Patent 10 94 270. In this heretofore known device, the swivel parts are mounted articulatingly on side walls of a machine frame, one side of which is penetrated by a projecting or overhanging end of the front lay shaft. This projecting end of the front lay shaft carries a cam-controlled lever. Thus, the force for reciprocatingly swivelling the front lay shaft about its longitudinal axis acts on one end of the front lay shaft. Especially with fast running printing machines, this may produce torsional and bending oscillations or vibrations with marked amplitudes in the front lay shaft so that there is no assurance that trouble-free feeding of a leading edge of a sheet to the front lays exists. As a result of these torsional and bending vibrations, the front lays can swivel locally and to a varying extent beyond an alignment position in and opposite to the feed direction of the sheet, which may possibly cause skewing or misalignment of the sheet or damage to the leading edge of the sheet.

It is accordingly an object of the invention to produce a device of the foregoing general type which, when installed in high-speed printing machines, keeps aligning errors and damage to leading edges of sheets to a minimum.

With the foregoing and other objects in view, there is provided, in accordance with the invention, a device for adjusting front lays of a printing machine to which sheets are individually fed by a sheet feeder, comprising a front lay shaft to which the front lays are connected so as to be fixed against rotation relative thereto, a first and a second swivel part respectively swivellable about a stationary geometric swivel axis common to the swivel parts, the front lay shaft being mounted in the first and the second swivel parts so as to be freely rotatable relative thereto, adjusting means engaging the first and the second swivel parts for changing the position of the front lay shaft, a swivel device for swivelling the front lay shaft reciprocatingly about a longitudinal axis thereof, and at least one supporting bearing for the front lay shaft for following changes in the position thereof, the adjusting means being in engagement with the front lay shaft in close proximity with the supporting bearing.

In accordance with another feature of the invention, there is provided a device, wherein each of the swivel parts is formed with a respective bearing in which the front lay shaft is rotatably mounted, and the at least one supporting bearing comprises a bearing lever having one end wherein the front lay shaft is freely rotatably supported, and another end secured to a swivel joint so that the bearing lever is swivellable about the common geometric swivel axis.

In accordance with an added feature of the invention there is provided a device wherein the bearing, respectively, in which the front lay shaft is rotatably mounted, is a swing bearing.

In accordance with an additional feature of the invention, there is provided a device wherein the bearing, respectively, in which the front lay shaft is rotatably mounted, is an adjusting bearing.

In accordance with a further feature of the invention, there is provided a device which includes a cross arm to which the bearing lever is connected, the cross arm having ends by which it is supported via respective swing bearings in the swivel parts.

In accordance with still another feature of the invention, there is provided a device wherein the swivel joint is constructed so as to afford at least a limited swivelling movement of the bearing lever about an imaginary longitudinal axis of the bearing lever.

In accordance with still an additional feature of the invention, there is provided a device wherein the supporting bearing is disposed intermediate the first and second swivel parts.

In accordance with a concomitant feature of the invention, there is provided a device wherein the supporting bearing is substantially equidistant from the first and second swivel parts.

With the swivel device acting approximately t the longitudinal middle of the front lay shaft, front lays swivelling beyond an alignment position do not result in an undesired inclined or skewed position of a sheet, even when torsional and bending vibrations of the front lay shaft occur because, in such a case, any possible deviations of the front lays from a given position occur substantially symmetrically to the point of application of the swivel device.

Furthermore, the maximum amplitudes of any possibly occurring torsional vibrations of the front lay shaft are sharply reduced.

In general, the point of force application of a swivel device for swivelling the front lay shaft is located outside the longitudinal axis of the front lay shaft. Thus, in addition to introducing or impressing a torque, such swivel devices also transmit lateral or transverse forces onto the front lay shaft. With the conventionally great distances between two bearings in which a front lay shaft is received and a point of force application of a swivel device located between these bearings, the aforementioned lateral or transverse forces may cause considerable bending of the front lay shaft. A disruptive effect of the bending on the trouble-free alignment of the sheets at the front lays, on the trouble-free transfer of aligned sheets to succeeding sheet transfer means equipped with grippers, and on a careful handling of the leading edges of the sheets by supporting the front lay shaft may, in fact, be prevented by means of a support bearing located preferably in the immediate proximity of the point of force application. In this regard, bending of the front lay shaft may, in fact, be counteracted, nevertheless, such an additional bearing would exclude any possibility of changing the position of the front lay shaft, if no further measures were taken.

To maintain a possibility of changing or adjusting the position of the front lay shaft, there is provided, in accordance with the invention, a supporting bearing which follows the changing positions of the front lays shaft.

In addition to the hereinabove-mentioned desirable properties resulting from an application of the swivel device approximately upon the longitudinal middle of the front lay shaft, the combination of features according to the invention also permits the elimination of the unfavorable influences i.e. bending of the front lay shaft, while, simultaneously, maintaining the possibility of being able to adjust the front lay shaft by means of the swivel parts.

Other features which are considered as characteristic for the invention are set forth in the appended claims.

Although the invention is illustrated and described herein as embodied in a device for adjusting front lays, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
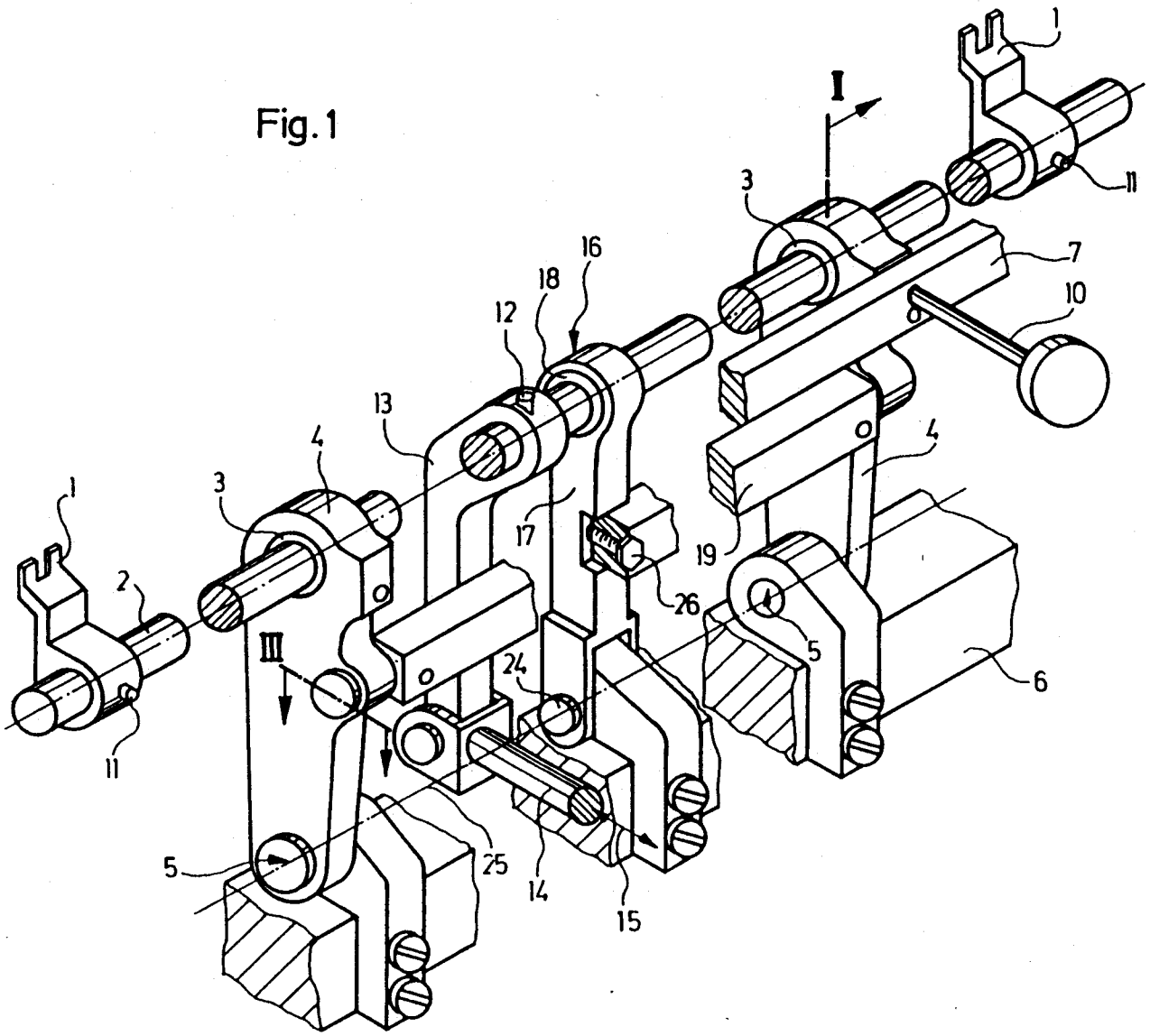
FIG. 1 is a perspective view, partly broken away and partly in section, of a device for adjusting front lays or guides according to the invention.
Figure 4:
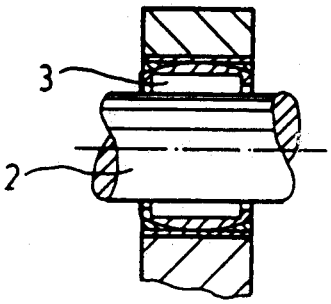
FIG. 4 is a partial sectional view of FIG. 2 taken along the line IV in the direction of the arrows.

Referring now to the drawing and, first, particularly to FIG. 1 thereof, there are shown front lays or guides which are connected by pins 11 to a front lay shaft 2 so that the front lays are fixed against rotation. In the interest of simplicity and clarity only two of the front lays 1 which are distributed along the length of the front lay shaft 2 are shown in the drawing. By means of swing bearings 3, the front lay shaft 2 is mounted so as to be freely rotatable in respective swivel parts 4, each of the swing bearings 3 being inserted into an upper end of a respective swivel part 4. As shown in FIG. 4, the swing bearing 3 has an outer ring and an inner ring in which the front lay shaft 2 is rotatable. By means of a respective articulating or swivel joint 5, a respective lower end of a swivel part 4 is connected to a stationary cross bar or traverse 6 having respective ends which are attached to non-illustrated side walls. The joints 5 form a geometric swivel axis 25 common to the swivel parts 4 and thus permit swivelling of the swivel parts 4 in and opposite to a feed direction of the sheets i.e. substantially perpendicularly to the swivel axis 25.

Figure 2:
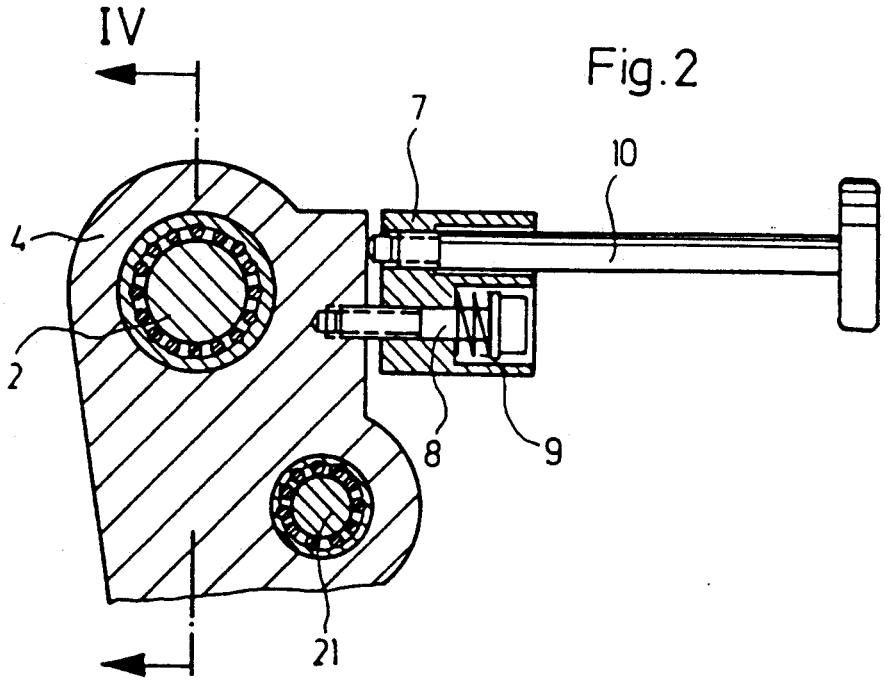
FIG. 2 is a cross-sectional view of FIG. 1 taken along the line II in the direction of the arrow.

The respective swivel position of the swivel parts 4 is defined by adjusting means which are illustrated in detail in FIG. 2. In this regard, another stationary cross bar 7 is provided opposite the upper ends of the swivel parts 4. A respective tightening or clamping screw 8 projecting through the cross bar 7 is screwed into the upper end of the respective swivel parts 4. A spring 9 which is tightened or held under the supporting surface of a screw head of the tightening screw 8 and braced against the cross bar 7 presses the respective swivel part 4 in a direction towards the cross bar 7 and against an adjustable stop formed by an adjusting spindle 10 mounted in the crossbar 7.

In the interest of simplicity and clarity, FIG. 1 shows only a portion of the cross bar 7 located opposite the swivel part 4 on the right-hand side of the drawing of FIG. 1 and, accordingly, only one adjusting spindle 10.

By means of a pin 12, a swing lever 13 is connected so as to be fixed against rotation to the front lay shaft 2. This swing lever 13 serves to swivel the front lay shaft 2 about its longitudinal axis and, according to the invention, is disposed in direct proximity to an additional supporting bearing 16 for the front lay shaft 2. The swing lever 13 has an end facing away from the front lay shaft 2 and articulatingly mounted on a connecting rod 14 of an otherwise non-illustrated crank drive, by means of which the connecting rod 14 is moved back and forth with the beat or rhythm of the printing machine, in accordance with the double headed arrow 15.

Between the two swivel parts 4, the front lay shaft 2 is received in at least one additional supporting bearing 16 which follows the position changing of the front lay shaft 2 resulting from swivelling of the swivel parts 4 in unison or individually about the joints 5 by means of the adjusting spindles 10. The supporting bearing 16 receives the front lay shaft 2 so that it is freely rotatable in a needle bearing 18 which is inserted into a bearing lever 17.

The bearing lever 17 is connected at an end thereof to a cross bar 6 by a further articulating joint 24 and fastened, at another location thereof, to a cross bar 19. The joint 24 is formed, for example, of another, non-illustrated, swing bearing similar to the swing bearing 3, having an outer ring which is in alignment with the geometric swivel axis 25 common to the swivel parts 4, and an inner ring into which a link pin connected to the bearing lever 17 is inserted so that the bearing lever 17 is also able to perform a limited swivelling movement about an imaginary longitudinal axis of the bearing level 17. The cross bar 19 extends from one swivel part 4 to the other swivel part 4. Each end of the cross bar 19 is swivel-mounted on a respective swivel part 4 between an upper and a lower end of the respective swivel part 4.

Figure 3:
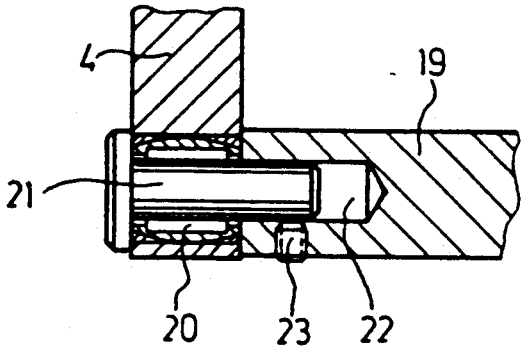
FIG. 3 is a cross-sectional view of FIG. 1 taken along the line III in the direction of the arrows.

Such a swivel connection is illustrated in FIG. 3 wherein a respective swivel part 4 is shown provided with a swing bearing 20. A bolt 21 is inserted into the respective swing bearing 20, fitting into a front-end bore 22 formed in the cross bar 19, and is secured in position in the cross bar 19 by means of a locking screw 23.

The cross bar 19 which follows the changing positions of the swivel parts 4 and thus those of the front lay shaft 2 is rigidly connected to the bearing lever 17 by a screw connection 26. The needle bearing 18 inserted into the bearing lever 17 thus follows the changing positions of the front lay shaft 2 and simultaneously supports the front lay shaft 2 effectively against bending which would otherwise be caused by the action or engagement of the swing lever 13.

The swivel connection between the connecting rod 14 and the swing lever 13 is constructed so that, in case of a nonuniform adjustment of the two swivel parts 4, the swing lever 13, too, is able to perform a limited swivelling movement about its imaginary longitudinal axis.

The foregoing is a description corresponding in substance to German Application P 38 30 081.8, dated Sept. 3, 1988, the International priority of which is being claimed for the instant application, and which is hereby made part of this application. Any material discrepancies between the foregoing specification and the aforementioned corresponding German application are to be resolved in favor of the latter.

I claim:

1. Device for adjusting front lays of a printing machine to which sheets are individually fed by a sheet feeder, comprising a front lay shaft to which the front lays are connected so as to be fixed against rotation relative thereto, a first and a second swivel part respectively swivellable about a stationary geometric swivel axis common to said swivel parts, said front lay shaft being mounted in said first and said second swivel parts, through the intermediary of respective supportive bearings, so as to be freely rotatable relative thereto, adjusting means engaging said first and said second swivel parts for changing the position of said front lay shaft, a swivel device for swivelling said front lay shaft about a longitudinal axis thereof, and at least one additional supporting bearing for said front lay shaft, said additional supporting bearing being disposed between said first and said second swivel parts and being constrained to follow changes in the position of said front lay shaft, said swivel device being in engagement with said front lay shaft in close proximity with said additional supporting bearing.

2. Device according to claim 1, wherein said additional supporting bearing comprises a bearing lever having one end wherein said front lay shaft is freely rotatably supported, and another end secured to a swivel joint so that said bearing lever is swivellable about said common geometric swivel axis.

3. Device according to claim 2, wherein said first-mentioned supporting bearing is a swing bearing.

4. Device according to claim 2, wherein said first-mentioned supporting bearing is an adjusting bearing.

5. Device according to claim 2, including a cross arm to which said bearing lever is connected, said cross arm having ends by which it is supported via respective swing bearings in said swivel parts.

6. Device according to claim 2, wherein said swivel joint is constructed so as to afford at least a limited swivelling movement of said bearing lever about an imaginary longitudinal axis of said bearing lever.

7. Device according to claim 1, wherein said additional supporting bearing is substantially equidistant from said first and second swivel parts.

* * * * *